United States Patent [19]

Piazzetta

[11] Patent Number: 4,558,688

[45] Date of Patent: Dec. 17, 1985

[54] FIREPLACE-HEATER WITH FULL RECOVERY OF HOT AIR

[75] Inventor: Domenico Piazzetta, Casella d'Asolo, Italy

[73] Assignee: Piazzetta S.p.A., Casella d'Asolo, Italy

[21] Appl. No.: 523,488

[22] Filed: Aug. 15, 1983

[30] Foreign Application Priority Data

Aug. 27, 1982 [IT] Italy ..... 30785/82[U]

[51] Int. Cl.[4] ..... F24B 3/00; F24C 15/30

[52] U.S. Cl. ..... 126/67; 126/123; 126/126

[58] Field of Search ..... 126/123, 126, 103, 21 R, 126/66, 67, 69, 70, 76

[56] References Cited

U.S. PATENT DOCUMENTS

| | | | |
|---|---|---|---|
| 73,886 | 1/1868 | Gaston | 126/83 |
| 945,994 | 1/1910 | Vondenbosch | 126/83 |
| 4,010,728 | 3/1977 | Hempet et al. | 126/121 X |
| 4,154,210 | 5/1979 | Jaymes et al. | 126/245 |

*Primary Examiner*—Larry Jones

*Attorney, Agent, or Firm*—Guido Modiano; Albert Josif

[57] ABSTRACT

An improved, full hot air recovery, fireplace-heater is disclosed, wherein the flue gases are forced to follow obliged paths through exchange chambers before being exhausted to the outside. The fireplace comprises a hearth and a plurality of chambers for the circulation of flue gases, which are serially arranged one another on the exterior of the hearth and surrounded by an outer chamber for the circulation of ambient air where the flue gas heat is recovered by exchange at walls. Also provided is a means for forcing the circulation of ambient air through the chamber.

3 Claims, 4 Drawing Figures

FIREPLACE-HEATER WITH FULL RECOVERY OF HOT AIR

BACKGROUND OF THE INVENTION

This invention relates to a fireplace-heater with full recovery of hot air.

SUMMARY OF THE INVENTION

It is an object of the invention to provide a fireplace or heater which can recover the largest possible amount of heat which would otherwise be lost with the flue gases.

A consequent important object is to provide a structure wherein the flue gases, prior to being exhausted, are obliged to follow definite paths through exchange chambers.

A further object is that of providing a simple modular structure which can fit fireplaces with different outward shapes.

These and other objects, such as will be apparent hereinafter, are achieved by a fireplace-heater with full recovery of hot air, comprising a hearth and at least one smoke chamber, characterized in that it has a plurality of smoke chambers serially arranged on the exterior of said hearth, said chambers being in turn enclosed in an outer ambient air circulation chamber for recovering heat from the flue gases by thermal exchange at wall members, a means being also provided to force said circulation of ambient air.

BRIEF DESCRIPTION OF THE DRAWINGS

Further features of the invention will be more clearly apparent from the following description of an embodiment thereof with reference to the accompanying illustrative drawings, where.

DESCRIPTION OF THE PREFERRED EMBODIMENTS

Figure 1:
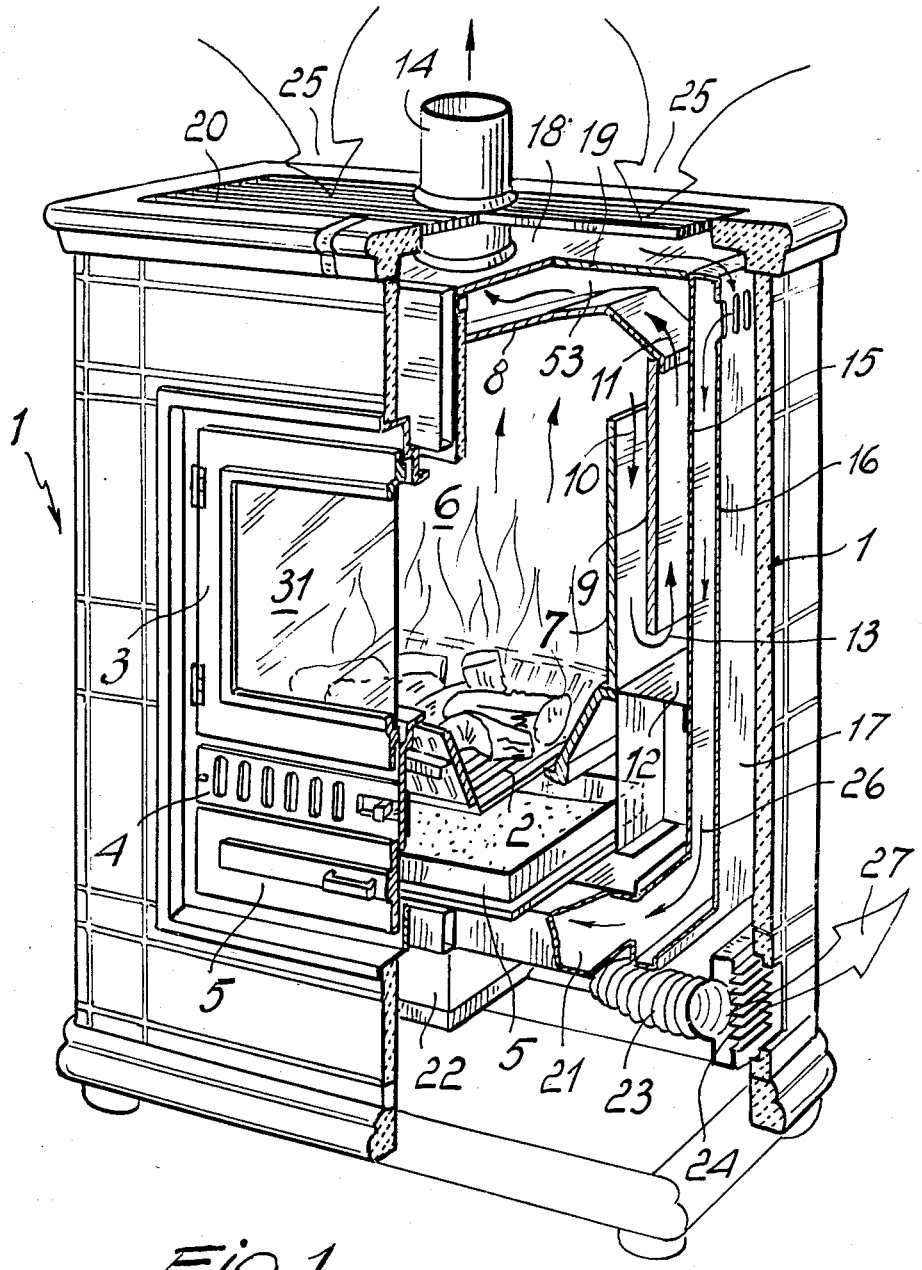
FIG. 1 is a partly sectional perspective view of a space heater according to the invention.
Figure 2:
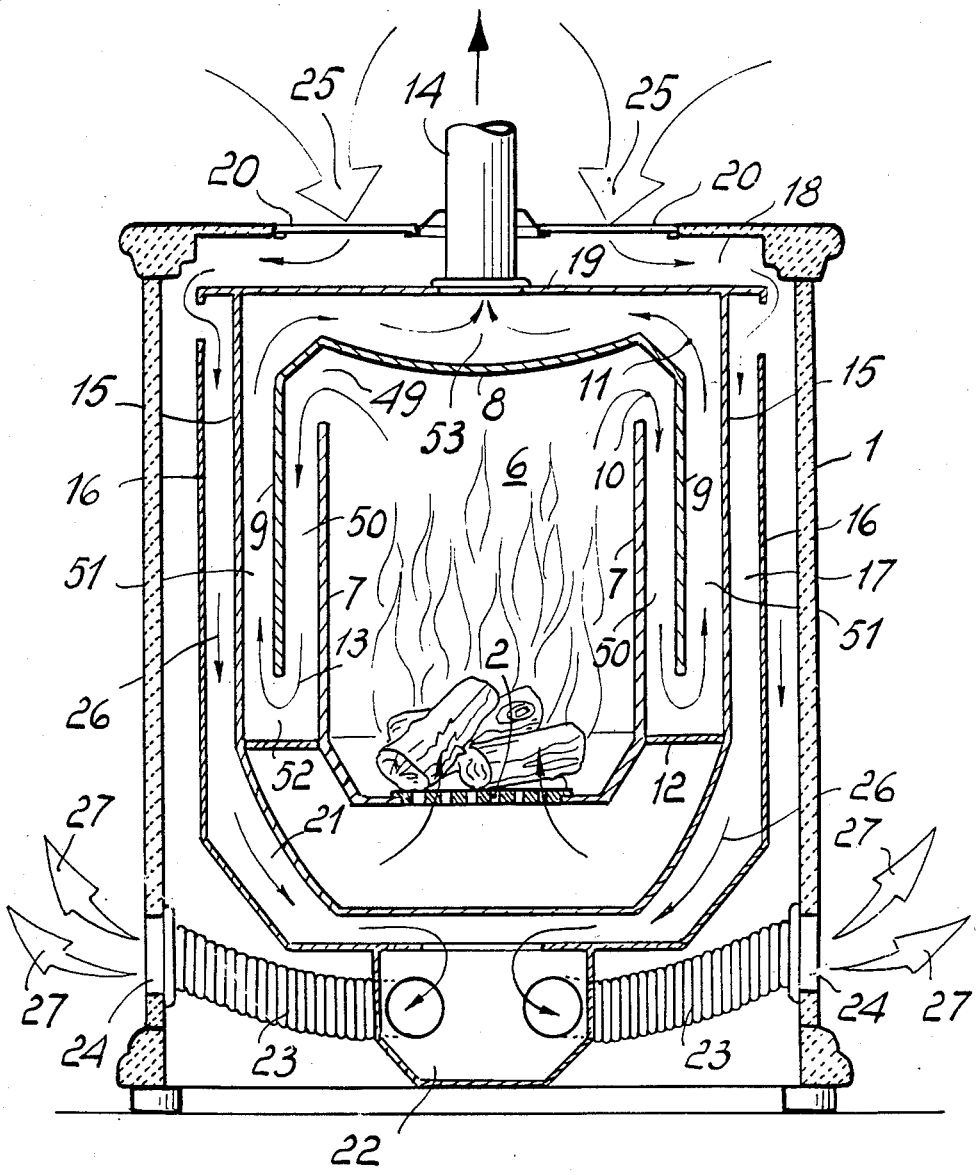
FIG. 2 is a midsection view schematically illustrating the circulation path of the flue gases relatively to the space heater of FIG. 1.

Making reference to the drawing figures, a space heater according to the invention comprises an outer enclosing body or casing of glazed ceramic material, indicated at 1 and enclosing a metal structure, specifically a cast iron one, which comprises a brazier 2 closed at the front by a door 3 having a glass window 31 and being fed with combustion air through a slotted grid 4 located on the front wall of the outer body 1, under the door 3 and above an ash collecting tray 5. Said brazier forms the bottom portion of a combustion chamber 6 defined laterally by first vertical sidewalls 7 and at the top by a substantially horizontal ceiling 8. Said first walls 7 extend at the bottom from the brazier 2 but end short of the ceiling 8 to leave a top side opening 49 for the passage of the flue gases.

Said first walls 7 and said brazier 2 define a first U-shaped wall structures with vertical wing portions coinciding with the walls 7 and a horizontal web portion coinciding with the brazier 2.

The ceiling 8 is connected laterally to second vertical walls 9 arranged parallel outside of the walls 7 and forming therewith a first chamber or interspace passage 50 swept by flue gases in a downward direction, as shown by the arrow 10. The ceiling 8 and the second sidewalls 9 define an inverted U-shaped wall structure with vertical wing portions conciding with the second sidewalls 9 and a horizontal web portion coinciding with the ceiling 8. Additional sidewalls 15, located outside of the walls 9, form with the latter a second chamber 51 swept by flue gases in an upward direction, as shown by the arrow 11. Also the sidewalls 15 are part of a U-shaped wall structure with a pair of opposite vertical wings and a horizontal web portion connecting the wings at their lower end. If desired, to reverse the flue gas flow direction, there may be provided a baffle 12 located at a distance away from the bottom edges of the walls 9 so as to create a bottom side opening 52 and force the flue gases to reverse their direction as shown by the arrow 13.

Provided above the ceiling 8 is a chamber 53 whereinto the flue gases from the chamber 51 are directed and which is connected directly to a chimney union 14.

Externally to the walls 15, there is formed, by means of a parallel sector 16, an air passage vertical chamber 17 which is connected at the top to an interspace 18 the base 19 whereof provides separation from the upper flue gas chamber 53, the interspace 18 being in communication at the top with the ambient air through a grid 20. The parallel sector 16 is also in the form of a U-shaped wall structure with vertical wings and a horizontal web portion connecting the lower ends of the wings.

The vertical chamber 17 is connected at the bottom to an intake chamber 21 which is connected to the suction side of a ventilating unit 22 the delivery side whereof opens, through flexible hoses 23, to grids 24 located in the lower portion of the outer enclosing body 1.

The path of the ambient air forced by the ventilation unit 22 is shown by the intake arrows 25 which are continued by the downward flow arrows 26 and hot air ejection arrows 27.

In practice, the hot flue gases generated by the combustion on the brazier 2 rise toward the upper portion of the combustion chamber 6 and flow downwards along a first downward flow path, to then flow again upwardly toward the chimney, thus delivering their heat to the wall assembly, which are all formed from good heat conducting materials, such as cast iron.

The ambient air is instead picked up from above and sweeps the walls heated by the flue gases in countercurrent relationship to then exhaust downwardly back to the ambient.

Figure 4:
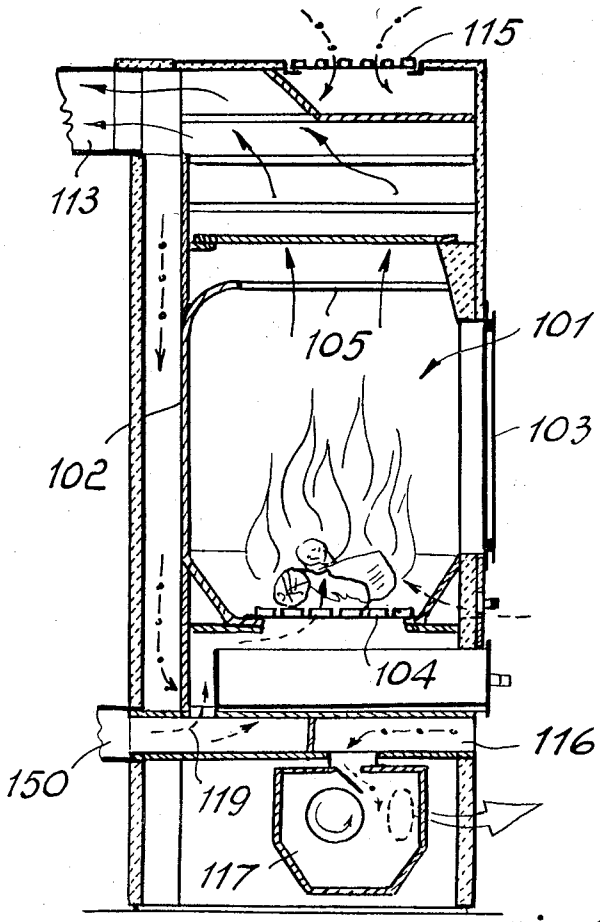
FIG. 4 shows a sectional view of the heater of FIG. 3, as taken on a parallel plane to the side face thereof.
Figure 3:
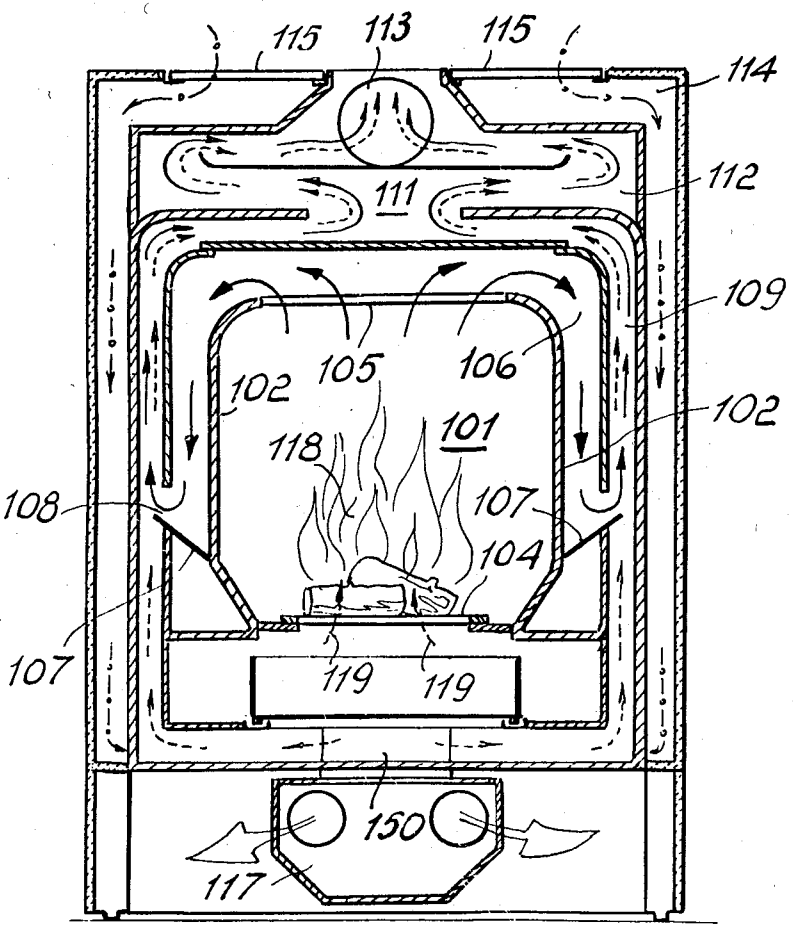
FIG. 3 shows a second diagram of the flue gas circulation path in a modified embodiment with respect to the heater of FIGS. 1 and 2, the view being taken on a front midplane of the heater.

FIGS. 3 and 4 show a second embodiment of the invention which incorporates modifications to the flue gas circulation and ambient air chambers.

With reference to the latter figures, the invention comprises here a hearth 101 forming the combustion chamber and having a substantially box-like shape with side and rear walls 102, a glass front access door 103, hearth bottom with a grid 104, and top flue gas exhaust opening 105.

Said top opening 105 communicates with a first inverted-U chamber 106 which is closed at the bottom by a partition 107, whereat it has a peripheral opening 108 communicating with a second enveloping chamber 109 open to the outside at its lowermost portion.

The partition 107 spans partially also said second chamber 109 to form a baffle.

In its upper portion, said second chamber 109 has an opening 111 which communicates with a third chamber 112 in communication with the chimney 113.

The assembly formed by said three chambers 106, 109 and 112 is contained within an outer chamber 114 provided at the top with a grid 115 and at the bottom with a connection 116 with a forced ventilation unit 117.

The flue gases 118 generated by the combustion supported by outside air 119 as indicated by the dashed arrows and in turn indicated by full line arrows move upwards toward the top opening 105, whence they flow down into the first chamber 106 as far as the partition 107, whereat they reverse their direction to flow up into the second chamber 109.

The provision of the baffle 107 which spans partly the chamber allows the outside air indicated by the dash line arrows to become mixed with the flue gases from said first chamber 106. The baffle 107, by narrowing the section of the chamber 109 creates a Venturi effect which accelerates the flue gas speed of upflow, said gases, on leaving through the opening 111, flowing into the third chamber 112 and hence out through the chimney 113.

The ambient air indicated by the dash-and-dot arrows is sucked in countercurrent relationship through the openings 150 and sweeps the hot chamber exteriors to be returned to the ambient by the ventilating unit 117.

The walls of the various chambers 106,109 and 112, which are formed from good heat conductive metal materials, provide a means for transferring the heat from the flue gases to the outer chamber which receives the ambient air.

The lengthened flue gas path enables the achievement of the highest rate of heat exchange, thereby the flue gases will reach the chimney at a significantly low temperature but sufficient to ensure their ejection to the outside.

The ambient air sucked in in countercurrent relationship from above is heated, thus recovering a large amount of heat which is then returned to the ambient.

I claim:

1. A fireplace heater comprising a combustion chamber with a bottom including a brazier and a substantially horizontal ceiling, opposite to said bottom, first sidewalls extending substantially vertically from said bottom of said combustion chamber but ending short of said substantially horizontal ceiling thereby forming a top side opening, said substantially horizontal ceiling being connected laterally to second vertical walls at the upper ends thereof, said second vertical walls being located parallely outside of said first walls forming a first flue gas chamber therebetween, additional sidewalls located parallely outside of said second vertical sidewalls and further forming a second flue gas chamber therebetween, a horizontal plate, in communication with a flue, associated laterally with the upper ends of said additional sidewalls thereby closing said second flue gas chamber at its upper end, said horizontal plate being substantially parallel to said substantially horizontal ceiling and defining a third flue gas chamber therebetween, said additional sidewalls extending below said brazier and communicating thereat to form a space below said combustion chamber, an ash collecting tray removably housed, in said space, a back plate rearwardly closing, said first, second, and third flue gas chambers, and said combustion chamber baffles, provided between the faces of said additional sidewalls and said first vertical walls, located at a distance below the lower ends of said second vertical walls, thereby creating a bottom side opening, forcing the flue gasses to reverse their direction of movement.

2. A fireplace heater according to claim 1, wherein said first flue gas chamber defines an inverted U-shape in communication with said combustion chamber through a flue gas exhaust opening, and said baffles only partially span said second flue gas chamber and are provided proximate to said lower ends of said second vertical walls defining bottom side openings of smaller cross sectional area than said flue gas chambers, and comprising an air intake which communicates with said air intake chamber said ventilating unit and a source of ambient air other than the ambient air within the room in which said fireplace heater is installed.

3. A fireplace heater comprising:

a combustion chamber including a brazier, a first U-shaped wall structure surrounding said combustion chamber and having a pair of first opposite vertical wing portions with free upper ends and a horizontal first web portion connecting said wing portions at their lower ends, said horizontal web portion defining said brazier, a second U-shaped wall structure having a size greater than that of said first U-shaped wall structure and surrounding at a distance therefrom said first U-shaped wall structure to provide a U-shaped interspace therebetween with a lower horizontal interspace portion and a pair of opposite vertical interspace portions open upwardly, said second U-shaped wall structure having a pair of opposite second vertical wing portions with top end and lower ends and a second horizontal web portion connecting said second wing portions at their lower ends, said second vertical wing portions extending upwardly beyond said free upper ends of said first vertical wing portions and having upwardly a horizontal plate connecting said second vertical wing portions at their top ends and located at a distance from said free upper ends of said first vertical wing portions, said horizontal plate having an opening for the passage of combustion gases therethrough at an intermediate location of said horizontal plate, an inverted U-shaped third wall structure having a size greater than that of said first U-shaped wall structure and smaller than that of said second U-shaped wall structure thereby to surround at least a top part of said first U-shaped wall structure and be surrounded by said second U-shaped wall structure, said inverted U-shaped third wall structure having a pair of opposite third vertical wing portions with upper extremities and free lower extremities and extending into said opposite vertical interspace portions and ending with said lower extremities thereof at a distance from said horizontal interspace portion, said inverted U-shaped third wall structure having further a substantially horizontal third web portion connecting said third vertical wing portions at their upper extremities, said third web portion being located between said horizontal plate and said upper ends of said first vertical wing portions, to define together with said horizontal plate an upper horizontal interspace portion, thereby said first, said second and said third wall structures defining at said first, said second and said third pair of opposite vertical wing portions thereof, within said pair of opposite vertical interspace portions, a first pair of vertical passages defined between said first vertical wing portions and said second vertical wing portions and in communication with said combustion chamber and further a second pair of vertical passages defined between said third vertical wing portions and said second vertical wing portions and in communication downwardly with said first pair of vertical passages and upwardly with said upper horizontal interspace portion thereby allowing combustion gases to flow from said combustion chamber through said first and said second pair of vertical passages and through said upper horizontal interspace portion towards said opening for the passage of combustion gases, a fourth U-shaped wall structure having a size greater than that of said second wall structure and including a pair of opposite fourth vertical wing portions outwardly at a distance from said second vertical wing portions to define a fourth vertical passage therebetween, and a fourth horizontal web portion connecting lowerly said opposite vertical wing portions, said fourth horizontal web portion being arranged at a distance from said second horizontal web portion to form a second horizontal interspace therebetween in communication with said fourth vertical passage, said fourth horizontal web portion having an aperture therein for the passage of air therethrough, a casing surrounding said first, said second, said third and said fourth wall structures at a distance therefrom to define with said fourth wall structure interspace passages for air to be heated in communication with said fourth vertical passages, said casing having a top plate upwardly at a distance from said horizontal plate to define therebetween a top interspace in communication with said fourth vertical passages for air to be heated, said top plate having an inlet therein for the air to be heated.

* * * * *